US009133998B2

(12) United States Patent
Saito et al.

(10) Patent No.: US 9,133,998 B2
(45) Date of Patent: Sep. 15, 2015

(54) VEHICULAR ILLUMINATION LAMP

(71) Applicants: Junichi Saito, Shizuoka (JP); Hiroyuki Makino, Shizuoka (JP)

(72) Inventors: Junichi Saito, Shizuoka (JP); Hiroyuki Makino, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 166 days.

(21) Appl. No.: 13/742,622

(22) Filed: Jan. 16, 2013

(65) Prior Publication Data

US 2013/0188379 A1 Jul. 25, 2013

(30) Foreign Application Priority Data

Jan. 19, 2012 (JP) ..... 2012-009479

(51) Int. Cl.
*F21V 7/00* (2006.01)
*F21S 8/10* (2006.01)

(52) U.S. Cl.
CPC ..... *F21S 48/1317* (2013.01); *F21S 48/137* (2013.01); *F21S 48/1376* (2013.01); *F21S 48/1168* (2013.01); *F21S 48/147* (2013.01)

(58) Field of Classification Search
CPC . F21S 48/1225; F21S 48/1388; F21S 48/142; F21S 48/147; F21S 48/137; F21S 48/1376
See application file for complete search history.

(56) References Cited

U.S. PATENT DOCUMENTS 5,199,779 A * 4/1993 Sato ..... 362/538
6,000,816 A * 12/1999 Serizawa et al. ..... 362/297

FOREIGN PATENT DOCUMENTS

JP 2003-288804 A 10/2003

* cited by examiner

*Primary Examiner* — Karabi Guharay
*Assistant Examiner* — Zachary J Snyder
(74) *Attorney, Agent, or Firm* — DLA Piper LLP (US)

(57) ABSTRACT

A parabola type vehicular illumination lamp that forms a low-beam distribution pattern with a horizontal cut-off line at its upper end, including a reflector (34) formed in its lower reflection area (34*a*1) with a light non-incident area (34*a*L1) on which light from a light source bulb (32) is not incident since the light is blocked by a shade (36) provided in front of the light source bulb (32). The light non-incident area (34*a*L1) of the reflector (34) has an additional reflection portion (34*a*L1A) for reflecting light, which is from the light source bulb (32) and reflected by the upper reflection area (34*au*) of the reflector (34) and then reflected by the upper area (14*u*) of a translucent cover (14), in a direction below the horizontal cut-off line of the low-beam distribution pattern.

4 Claims, 3 Drawing Sheets

VEHICULAR ILLUMINATION LAMP

BACKGROUND OF THE INVENTION

1. Field of the Invention

The present invention relates to so-called parabola type vehicular illumination lamps configured to form a light distribution pattern having a cut-off line at its upper end.

2. Description of the Related Art

Conventionally, in parabola type vehicular illumination lamps configured to reflect light from the light source forward by a reflector, the lamp configuration includes a shade that blocks light traveling downward from the light source so as to form a light distribution pattern that has a cut-off line at its upper end (e.g., a low-beam distribution pattern).

Japanese Patent Application Laid-Open (Kokai) No. 2003-288804 describes a parabola type vehicular illumination lamp that includes such a shade as described above, and in this lamp a translucent cover is provided in front of the reflector such that the translucent cover is inclined in the lateral direction, and part of reflected light from the reflector, which has been reflected by the translucent cover, is reflected outward in the lateral direction of a vehicle by a partial reflection area formed on the reflector.

The vehicular illumination lamp described in Japanese Patent Application Laid-Open (Kokai) No. 2003-288804 has the following problem. In this vehicular illumination lamp, not only the reflected light from the translucent cover but also the light directly emitted from the light source are incident on the partial reflection area of the reflector. Accordingly, if the vehicular illumination lamp is configured such that the partial reflection area reflects the reflected light from the translucent cover outward in the lateral direction of the vehicle, reflection control on the light directly emitted from the light source cannot be accurately performed, which affects formation of a light distribution pattern.

In parabola type vehicular illumination lamps, when an upper area of the translucent cover is inclined rearward, part of reflected light from the upper reflection area of the reflector is incident on the lower reflection area of the reflector after being reflected by the upper area of the translucent cover, depending on the inclination angle of the translucent cover, and since the light reflected by the lower reflection area includes light that travels upward, depending on the shape of a reflective surface thereof, this reflected light causes glare for oncoming drivers.

As a solution, the lower reflection area of the reflector can be configured to reflect the reflected light from the upper area of the translucent cover in a diffused manner, thus reducing glare for oncoming drivers.

However, even in this structure, it is not enough to effectively prevent glare for oncoming drivers, and light that is reflected by the upper area of the translucent cover and incident onto the lower reflection area of the reflector cannot be used effectively.

BRIEF SUMMARY OF THE INVENTION

The present invention was developed in view of the above problems, and it is an object of the present invention to provide a parabola type vehicular illumination lamp that is configured to form a light distribution pattern having a cut-off line at its upper end and that is capable of effectively using light from the light source without causing glare for oncoming drivers, even if the upper area of a translucent cover of the lump is inclined rearward.

The present invention achieves the above object by devising a configuration of the lower reflection area of a reflector.

More specifically, a vehicular illumination lamp according to the present invention includes: a light source; a reflector that reflects light from the light source forward; a translucent cover provided in front of the reflector; and a shade that blocks light traveling downward from the light source, and the lamp is configured to form a light distribution pattern having a cut-off line at its upper end, and this lump of the present invention is characterized in that:

- the translucent cover is, in its upper area, formed to extend rearward in an inclined manner, and
- the reflector has, in its lower reflection area, a light non-incident area on which light from the light source is not incident since blocked by the shade, and this light non-incident area is formed with an additional reflection portion for reflecting light, which is from the light source and reflected by an upper reflection area of the reflector and then reflected by the upper area of the translucent cover, in a direction below the cut-off line.

In the above structure, the type of the "light source" is not particularly limited. For example, a filament of a halogen lamp, a discharging light source of a discharge bulb, etc. can be used as the "light source."

The "shade" can be a member separate from a light source bulb or as part of the light source bulb, as long as it is configured to block the light traveling downward from the light source.

The "upper area of the translucent cover" refers to an area of the translucent cover which is located above the light source level.

The "upper reflection area of the reflector" refers to an area of a reflective surface of the reflector which is located above the light source axis level.

The "lower reflection area of the reflector" refers to an area of the reflective surface of the reflector which is located below the light source axis level.

As seen from the above, the vehicular illumination lamp according to the present invention is a parabola type lamp that includes a shade and forms a (basic) light distribution pattern having a cut-off line at its upper end, and the translucent cover provided in front of the reflector is formed such that its upper area extends rearward in an inclined manner, and in this structure, the lower reflection area of the reflector has a light non-incident area (that is, an area on which the light from the light source is not incident since the light is blocked by the shade), and this non-incident area is formed with an additional reflection portion for reflecting light, which is from the light source and reflected by the upper reflection area of the reflector and then reflected by the upper area of the translucent cover, in the direction below the cut-off line. Accordingly, the lamp has the following advantages.

The reflected light from the reflector, which is then reflected by the upper area of the translucent cover, is partially or entirely incident on the lower reflection area of the reflector, and in the light non-incident area of this lower reflection area, the additional reflection portion is form so that it reflects the reflected light from the upper area of the translucent cover in the direction below the cut-off line. Accordingly, the light that is reflected by the lower reflection area of the reflector is significantly reduced in a direction above the cut-off line, and thus glare for oncoming drivers is avoided.

In this structure, the additional reflection portion is formed in the light non-incident area on which the light from the light source is not incident since the light is blocked by the shade. Thus, since the additional reflection portion can be used as an area dedicated to control the reflected light from the translucent cover, the additional reflection portion neither affects formation of the light distribution pattern nor reduces brightness of the light distribution pattern.

Since the reflected light from the additional reflection portion travels in the direction below the cut-off line, this reflected light can be effectively used to increase the brightness of the light distribution pattern.

As seen from the above, according to the present invention, in a parabola type vehicular illumination lamp configured to form a light distribution pattern that has a cut-off line at its upper end, the light from the light source can be effectively used without causing glare for oncoming drivers, even if the upper area of the translucent cover is inclined rearward.

The vehicular illumination lamp of the present invention can be configured to form, by using the reflected light from the additional reflection portion, an additional light distribution pattern that diffuses in the lateral direction to a larger extent than the (basic) light distribution pattern. In this configuration, the road surface ahead of the vehicle can be widely illuminated, and visibility of the road surface is further enhanced.

In the present invention, the additional reflection portion can be formed in an upper end of the light non-incident area. In this configuration, even if an extension panel is provided between the lower end of the reflector and the translucent cover, the reflected light from the additional reflection portion is easily prevented from being blocked by the extension panel and is also prevented from serving as glare light since it is reflected upward by the upper surface of the extension panel.

DETAILED DESCRIPTION OF THE INVENTION

Hereinafter, an embodiment according to the present invention will be described with reference to the accompanying drawings.

Figure 1:
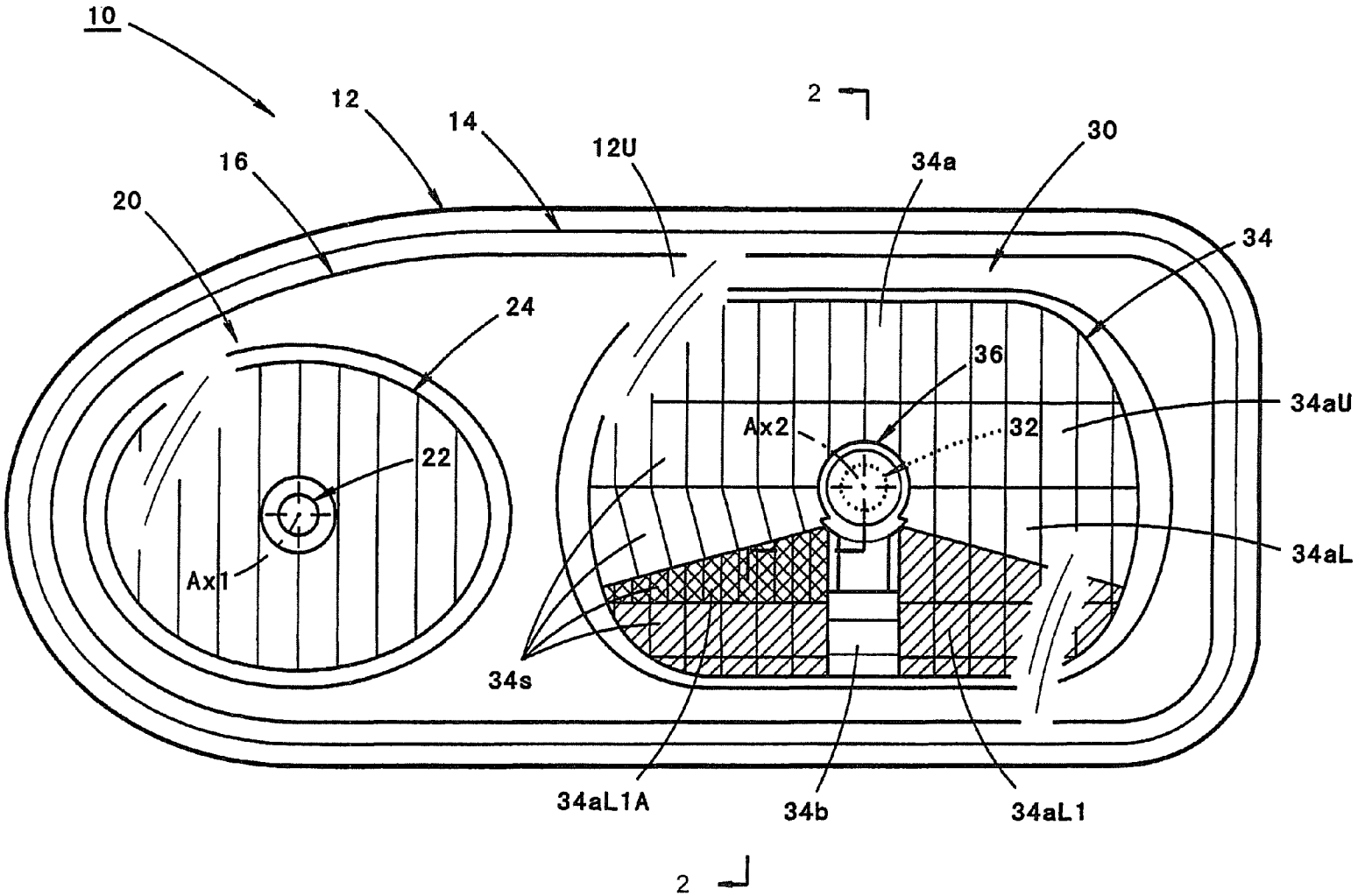
FIG. 1 is a front view showing a vehicular illumination lamp according to an embodiment of the present invention.
Figure 2:
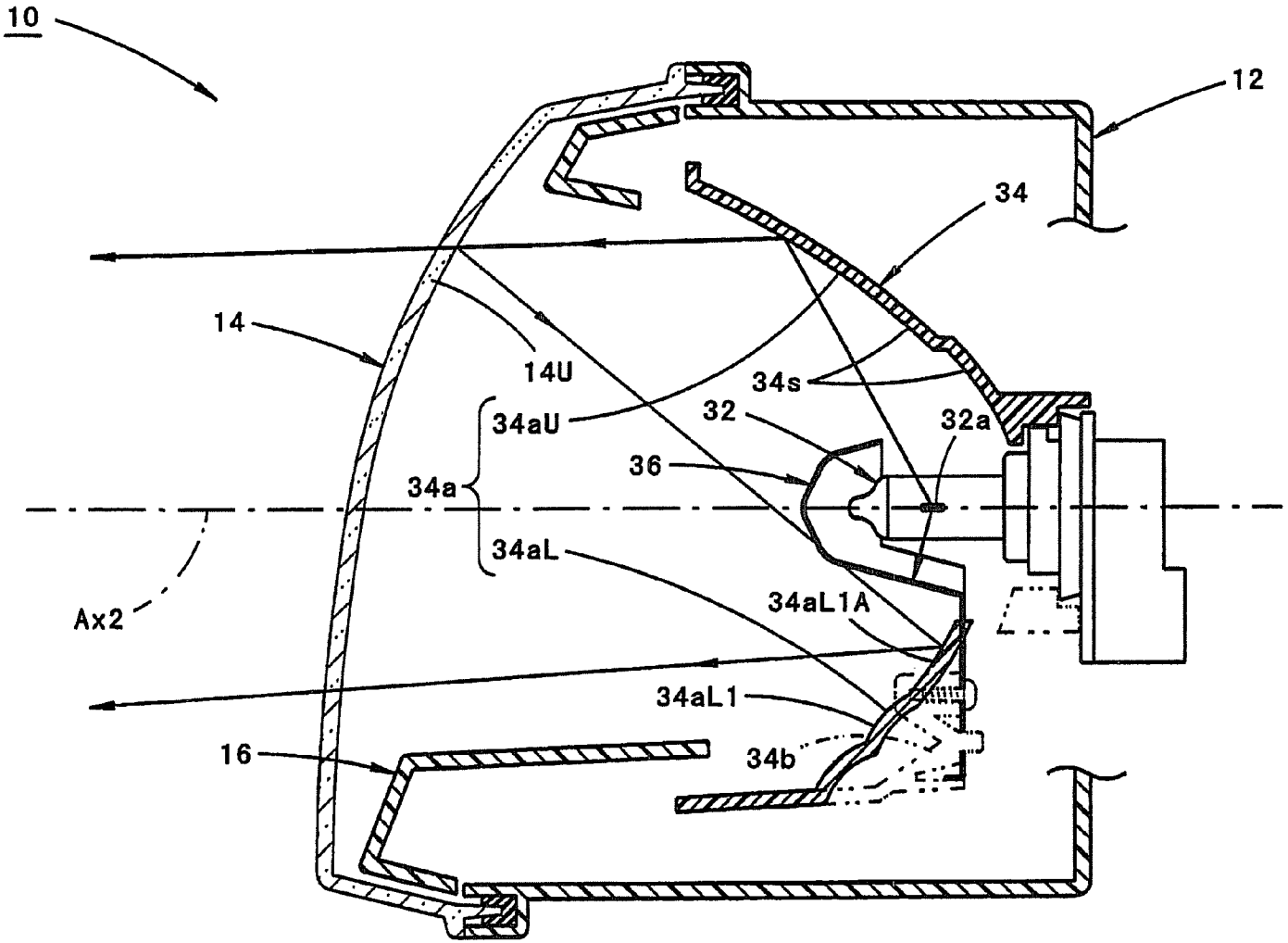
FIG. 2 is a sectional view taken along the line 2-2 in FIG. 1.

FIG. 1 is a front view showing a vehicular illumination lamp 10 according to an embodiment of the present invention, and FIG. 2 is a sectional view taken along the line 2-2 in FIG. 1.

As shown in these figures, the vehicular illumination lamp 10 according to the shown embodiment is provided in the left front end of a vehicle, and it is configured such that a first lamp unit 20 and a second lamp unit 30 are tiltably supported by a lamp body 12 via an aiming mechanism, not shown, in a lamp chamber that is formed by the lamp body 12 and a translucent cover 14 formed in a plain configuration and attached to the front end opening of the lamp body 12.

The lamp body 12 is formed in a horizontally long shape as viewed from a directly forward direction of the lamp. The second lamp unit 30 is provided outward of the first lamp unit 20 in the lateral direction of the vehicle. An extension panel 16 formed to surround the first and second lamp units 20, 30 are provided in the proximity of the front end opening of the lamp body 12 in the lamp chamber.

In this vehicular illumination lamp 10, a low-beam distribution pattern is formed by radiated light from the second lamp unit 30, and a high-beam distribution pattern is formed by radiated light from the first lamp unit 20 in addition to the radiated light from the second lamp unit 30.

The first lamp unit 20 is configured as a parabola type lamp unit, and it includes a light source bulb 22, which is provided on an optical axis Ax1 extending in the longitudinal direction of the lamp, and a reflector 24 that reflects light from the light source bulb 22 forward.

On the other hand, the second lamp unit 30 is configured also as a parabola type lamp unit, and it includes a light source bulb 32, which is provided on an optical axis Ax2 extending in the longitudinal direction of the lamp, a reflector 34 that reflects light from the light source bulb 32 forward, and a shade 36 that blocks light traveling downward from the light source bulb 32.

As shown in FIG. 2, the translucent cover 14 is formed to extend in a manner that the translucent cover 14 is inclined rearward from its lower end to its upper end with respect to a vertical direction. More specifically, the translucent cover 14 is formed such that its upper area 14U located above the optical axis Ax2 is inclined rearward to a large extent. This translucent cover 14 is also formed to extend in a manner that it is inclined rearward from the inner side in the lateral direction of the vehicle toward the outer side in the lateral direction of the vehicle.

A specific configuration of the second lamp unit 30 will be described below.

The light source bulb 32 is a halogen bulb that uses a filament 32*a* extending in the longitudinal direction of the lamp as its light source.

The reflector 34 has a reflective surface 34*a*, and this reflective surface 34*a* is fanned by reflective elements 34*s* that reflect light from the light source bulb 32.

Part of the lower reflection area (i.e., an area of the reflective surface 34*a* which is located below the optical axis Ax2 level) 34*a*L of the reflector 34 (specifically, the hatched area in FIG. 1) is configured as a light non-incident area 34*a*L1 on which the light from the light source bulb 32 (to be exact, light from the filament 32*a*) is not incident since the light is blocked by the shade 36.

The shade 36 is fixed to a shade supporting portion 34*b* of the reflector 34 at a position immediately below the optical axis Ax2.

As seen from FIG. 2, in the vehicular illumination lamp 10, the upper area 14U of the translucent cover 14 is inclined rearward to a large extent. Accordingly, part of the light from the light source bulb 32, which has been reflected by the upper reflection area (i.e., an area of the reflective surface 34*a* which is located above the optical axis Ax2 level) 34*a*U of the reflector 34, is reflected obliquely downward toward the back by the rear surface of the upper area 14U of the translucent cover 14. The reflected light from this upper area 14U of the translucent cover 14 is incident on the lower reflection area 34*a*L of the reflector 34, and most of this reflected light is incident on the light non-incident area 34*a*L1 of the reflector 34.

Part of the light non-incident area 34*a*L1 (specifically, the double hatched area in FIG. 1) of the reflector 34 is configured as an additional reflection portion 34*a*L1A that reflects the reflected light from the upper area 14U of the translucent cover 14 downward toward the front. This additional reflection portion 34*a*L1A is formed in a portion of the upper end of the light non-incident area 34*a*L1, which is located inward of the optical axis Ax2 in the lateral direction of the vehicle. Each of the reflective elements 34*s* forming this additional reflection portion 34$a$L1A is configured to reflect the reflected light from the upper area 14U as light that significantly diffuses in the lateral direction though hardly diffuses in the vertical direction.

Each of the reflective elements 34$s$ forming a general area of the light non-incident area 34$a$L1 other than the additional reflection portion 34$a$L1A is configured to reflect the reflected light from the upper area 14U of the translucent cover 14 as light that diffuses in the vertical and lateral directions significantly.

Figure 3:
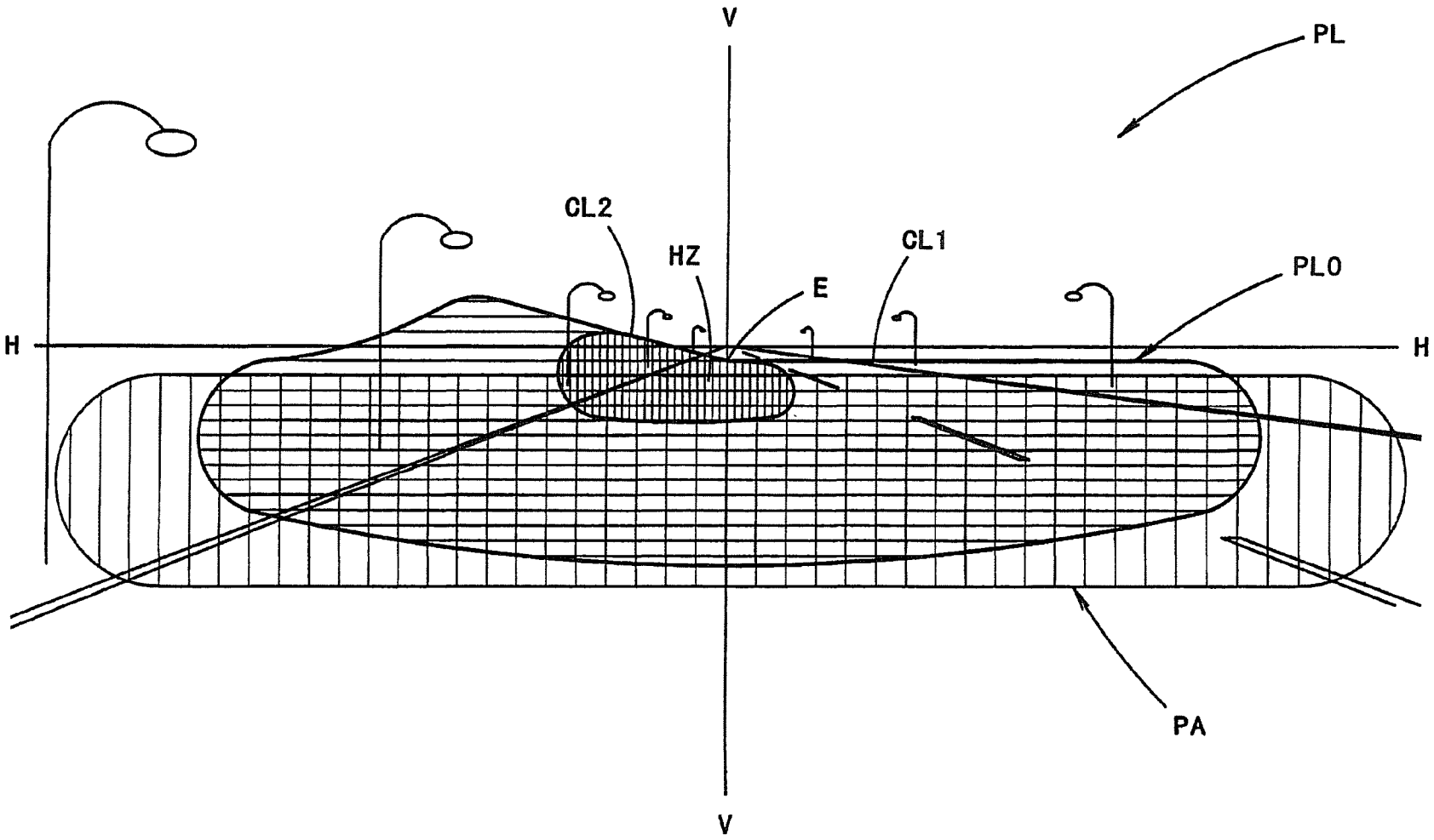
FIG. 3 is a perspective view showing a low-beam distribution pattern that is formed on an imaginary vertical screen positioned ahead of a vehicle by light radiated forward from a second lamp unit of the vehicular illumination lamp of the present invention.

FIG. 3 shows a low-beam distribution pattern PL that is formed on an imaginary vertical screen positioned 25 m ahead of the lamp, by light radiated forward from the second lamp unit 30.

As seen from this figure, the low-beam distribution pattern PL is a low-beam distribution pattern for the left side light distribution, and it is formed as a combined light distribution pattern of a basic light distribution pattern PL0 and an additional light distribution pattern PA.

The basic light distribution pattern PL0 is a light distribution pattern that is formed by the light directly emitted from the light source bulb 32 and then reflected forward by the reflective surface 34$a$ of the reflector 34.

This basic light distribution pattern PL0 has a cut-off line at its upper end, which is formed by a horizontal cut-off line CL1 and an oblique cut-off line CL2. The horizontal cut-off line CL1 is formed on the oncoming lane side with respect to the line V-V which is a vertical line passing through the intersection of lines H-V, whereas the oblique cut-off line CL2 is formed to extend obliquely upward toward the host vehicle lane side from the intersection of the horizontal cut-off line CL1 and the line V-V. The elbow point E, which is the intersection of the horizontal cut-off line CL1 and the oblique cut-off line CL2, is located at about 0.5 to 0.6° below the intersection of lines H-V. The hot zone HZ, which is an area of high-intensity light, is formed to surround the elbow point E more on the host vehicle lane side.

On the other hand, the additional light distribution pattern PA is a light distribution pattern that is formed by reflecting the light, which is emitted from the light source bulb 32 and reflected by the upper area 14U of the translucent cover 14, downward toward the front by the additional reflection portion 34$a$L1A of the light non-incident area 34$a$L1 that is in the lower reflection area 34$a$L of the reflector 34.

This additional light distribution pattern PA is formed below the horizontal and oblique cut-off lines CL1, CL2 as a light distribution pattern that diffuses in the lateral direction to an extent larger than the basic light distribution pattern PL0.

Of the reflected light from the upper area 14U, the light reflected by the general area of the light non-incident area 34$a$L1 other than the additional reflection portion 34$a$L1A significantly diffuses in the vertical and lateral directions. Accordingly, the light traveling in a direction above the horizontal cut-off line CL1 has considerably low intensity.

Advantages of the lamp of the shown embodiment of the present invention will be described below.

The vehicular illumination lamp 10 according to the shown embodiment is configured to form the low-beam distribution pattern PL by radiated light from the parabola type second lamp unit 30 that includes the shade 36, and in this lamp, the translucent cover 14 provided in front of the reflector 34 is formed such that its upper area 14U extends rearward in an inclined manner, and the lower reflection area 34$a$L of the reflector 34 has the light non-incident area 34$a$L1 on which light from the light source bulb 32 is not incident since the light is blocked by the shade 36, and this light non-incident area 34$a$L1 is formed with the additional reflection portion 34$a$L1A for reflecting light, which is from the light source bulb 32 and reflected by the upper reflection area 34$a$U of the reflector 34 and then reflected by the upper area 14U of the translucent cover 14, in the direction below the horizontal cut-off line CL1. Thus, the vehicular illumination lamp of the present invention has the following advantages.

The reflected light from the reflector 34 is reflected by the upper area 14U of the translucent cover 14, and then it is partially or entirely incident on the lower reflection area 34$a$L of the reflector 34, and in the light non-incident area 34$a$L1 of this lower reflection area 34$a$L, the additional reflection portion 34$a$L1A is formed so that it reflects the reflected light from the upper area 14U of the translucent cover 14 in the direction below the horizontal cut-off line CL1. Accordingly, light that is reflected by the lower reflection area 34$a$L in the direction above the horizontal cut-off line CL1 is significantly reduced, and thus glare for oncoming drivers can be avoided.

The additional reflection portion 34$a$L1A is formed in the light non-incident area 34$a$L1 on which the light from the light source bulb 32 is not incident since the light is blocked by the shade 36. Thus, the additional reflection portion 34$a$L1A can be used as an area dedicated to control the reflected light from the translucent cover 14, and formation of the additional reflection portion 34$a$L1A neither affects formation of the low-beam distribution pattern PL nor reduces the brightness of the low-beam distribution pattern PL.

Since the reflected light from the additional reflection portion 34$a$L1A travels in the direction below the horizontal cut-off line CL1, this reflected light can be effectively used to increase the brightness of the low-beam distribution pattern PL.

As seen from the above, according to the shown embodiment, in the parabola type vehicular illumination lamp 10 configured to form the low-beam distribution pattern PL, the light from the light source bulb 32 can be effectively used without causing glare for oncoming drivers, even if the upper area 14U of the translucent cover 14 is inclined rearward.

In addition, the vehicular illumination lamp 10 according to the shown embodiment is configured to form, by using the reflected light from the additional reflection portion 34$a$L1A, the additional light distribution pattern PA that diffuses in the lateral direction to a larger extent than the basic light distribution pattern PL0. Thus, a road surface ahead of the vehicle that has the vehicular illumination lamp 10 can be widely irradiated with light, and visibility of the road surface can be further enhanced.

Moreover, the vehicular illumination lamp 10 according to the shown embodiment, the additional reflection portion 34$a$L1A can be formed in the upper end of the light non-incident area 34$a$L1 of the reflector 34. In this structure, even though the extension panel 16 is provided between the lower end of the reflector 34 and the translucent cover 14, reflected light from the additional reflection portion 34$a$L1A is not blocked by the extension panel 16 and does not become glare light that is reflected upward by the upper surface of the extension panel 16.

Furthermore, in the vehicular illumination lamp 10 according to the shown embodiment, the translucent cover 14 is inclined rearward from the inner side in the lateral direction of the vehicle toward the outer side in the lateral direction of the vehicle. Accordingly, most of the light which has been reflected by the upper area 14U of the translucent cover 14 is incident on a portion of the lower reflection area 34$a$L of the reflector 34 which is located inward of the optical axis Ax2 in the lateral direction of the vehicle. In the shown embodiment, however, since the additional reflection portion 34$a$L1A is formed in this portion located inward of the optical axis Ax2 in the lateral direction of the vehicle, the above-described advantages can be effectively obtained.

In the embodiment described above, the vehicular illumination lamp 10 is configured to form the low-beam distribution pattern PL for a left side light distribution. However, even if the vehicular illumination lamp 10 is configured to form a low-beam distribution pattern for a right side light distribution or is configured to form a light distribution pattern having only a horizontal cut-off line at its upper end, the lamp has the same advantages by using a configuration similar to that of the above-described embodiment.

It should be understood that the numerical values shown as data in the above-described embodiment are by way of example only, and they can be set to different values as appropriate.

The invention claimed is:

1. A vehicular illumination lamp comprising: a light source; a reflector that reflects light from the light source forward; a translucent cover provided in front of the reflector; and a shade that blocks light traveling downward from the light source, said vehicular illumination lamp being configured to form a light distribution pattern having a cut-off line at its upper end, wherein:

the translucent cover is, in an upper area thereof, formed to be inclined rearward, and the reflector has, in a lower reflection area thereof, a light non-incident area on which light from the light source is not incident since blocked by the shade, and said light non-incident area is formed with an additional reflection portion for reflecting light, which is from the light source and reflected by an upper reflection area of the reflector and then reflected by the upper area of the translucent cover, in a direction below the cut-off line.

2. The vehicular illumination lamp according to claim 1, wherein said lamp is configured to form, by using the reflected light from the additional reflection portion, an additional light distribution pattern that diffuses in a lateral direction to a larger extent than said light distribution pattern.

3. The vehicular illumination lamp according to claim 1, wherein said additional reflection portion is formed in an upper end of said light non-incident area of said reflector.

4. The vehicular illumination lamp according to claim 2, wherein said additional reflection portion is formed in an upper end of said light non-incident area of said reflector.

* * * * *